US010239185B2

(12) United States Patent
Schaffer et al.

(10) Patent No.: US 10,239,185 B2
(45) Date of Patent: Mar. 26, 2019

(54) SELF-POWERED PRESSURIZED GRANULAR PARTICLE EJECTOR TOOL WITH REMOTE OPERATION

(71) Applicant: Innovative Etching LLC, Norwalk, CT (US)

(72) Inventors: Stephen Schaffer, Bethel, CT (US); Graves Kiely, Weston, CT (US)

(73) Assignee: Aeroetch Holdings, Inc., Norwalk, CT (US)

( * ) Notice: Subject to any disclaimer, the term of this patent is extended or adjusted under 35 U.S.C. 154(b) by 23 days.

(21) Appl. No.: 15/684,020

(22) Filed: Aug. 23, 2017

(65) Prior Publication Data

US 2019/0061105 A1 Feb. 28, 2019

(51) Int. Cl.

| | |
|---|---|
| ***B24C 3/06*** | (2006.01) |
| ***B24C 5/04*** | (2006.01) |
| *B24C 9/00* | (2006.01) |

(52) U.S. Cl.

CPC ..... *B24C 3/065* (2013.01); *B24C 5/04* (2013.01); *B24C 9/006* (2013.01)

(58) Field of Classification Search

CPC ..... B24C 7/04; B24C 3/06
USPC ..... 451/90, 99, 101, 75, 87, 88
See application file for complete search history.

(56) References Cited

U.S. PATENT DOCUMENTS

| | | | | |
|---|---|---|---|---|
| 709,448 | A | | 9/1902 | Shaver |
| 1,948,533 | A | | 2/1934 | Neely |
| 2,108,545 | A | | 2/1938 | Minich |
| 2,133,149 | A | | 10/1938 | Poncelet |
| 2,441,441 | A | | 5/1948 | Paasche |
| 2,526,403 | A | | 10/1950 | Paasche |
| 2,574,578 | A | | 11/1951 | Martinet |
| 2,725,684 | A | * | 12/1955 | Crowe ..... B24C 3/06 451/90 |
| 3,032,929 | A | | 5/1962 | Glesener |
| 3,163,963 | A | | 1/1965 | Caron |
| 3,625,403 | A | | 12/1971 | Rousselot |
| 3,626,841 | A | * | 12/1971 | Schachter ..... B24C 7/0053 451/90 |
| 3,704,811 | A | | 12/1972 | Harden, Jr. |

(Continued)

FOREIGN PATENT DOCUMENTS

| | | |
|---|---|---|
| DE | 3624023 | 1/1987 |
| EP | 0712693 | 2/2000 |

(Continued)

*Primary Examiner* — Robert Rose

(74) *Attorney, Agent, or Firm* — Ware, Fressola, Maguire & Barber LLP

(57) ABSTRACT

A hand-held ejector tool for ejecting a pressurized stream of abrasive materials and a hopper assembly for use in the same is provided. The hand-held ejector tool includes a pressurized air source, a hopper assembly and a delivery conduit for ejecting a pressurized stream of abrasive material. The hopper assembly includes a containment area to store an abrasive material, an air conduit to receive pressurized air from the pressurized air source, a one-way valve to provide the pressurized air into an upper portion of the containment area, and a mixing device to mix the abrasive material and the pressurized air to create a pressurized stream of abrasive material. The delivery conduit may include a stylus to permit a controllable ejection the pressurized stream of abrasive material.

20 Claims, 14 Drawing Sheets

(56) References Cited

U.S. PATENT DOCUMENTS

| | | | | |
|---|---|---|---|---|
| 3,852,918 | A * | 12/1974 | Black | B24C 7/0053 451/99 |
| 4,045,915 | A | 9/1977 | Gilbert et al. | |
| 4,090,334 | A | 5/1978 | Kurowski et al. | |
| 4,233,785 | A | 11/1980 | Abell | |
| 4,245,788 | A | 1/1981 | Wright | |
| 4,281,485 | A | 8/1981 | Charity, III | |
| 4,333,277 | A | 6/1982 | Tasedan | |
| 4,494,932 | A * | 1/1985 | Rzewinski | A61C 3/025 433/88 |
| 4,628,644 | A | 12/1986 | Somers | |
| 4,674,239 | A | 6/1987 | Jodoin | |
| 4,941,298 | A | 7/1990 | Fernwood et al. | |
| 5,181,349 | A | 1/1993 | Schaffer | |
| 5,514,026 | A | 5/1996 | Schaffer | |
| 5,839,946 | A | 11/1998 | Hertz | |
| 5,931,721 | A | 8/1999 | Rose et al. | |
| 6,939,205 | B2 | 9/2005 | Hopf et al. | |
| 7,387,140 | B2 | 6/2008 | Brunn | |
| 7,547,292 | B2 | 6/2009 | Sheldrake et al. | |
| 7,967,035 | B2 | 6/2011 | Brunn | |
| 8,540,665 | B2 | 9/2013 | Bates et al. | |
| 8,561,840 | B2 | 10/2013 | Greer, Jr. et al. | |
| 8,622,255 | B2 | 1/2014 | Greer, Jr. | |
| 8,657,516 | B2 | 2/2014 | Cagnina et al. | |
| 9,044,546 | B2 | 6/2015 | Bates et al. | |
| 9,307,880 | B2 | 4/2016 | Cagnina et al. | |
| 9,358,338 | B2 | 6/2016 | Bates et al. | |
| 2006/0211339 | A1 | 9/2006 | Woods | |
| 2008/0233540 | A1 * | 9/2008 | Olmo | A61C 3/025 433/215 |
| 2011/0056439 | A1 | 3/2011 | Tobita et al. | |
| 2013/0056547 | A1 | 3/2013 | Wilson et al. | |

FOREIGN PATENT DOCUMENTS

| | | |
|---|---|---|
| GB | 2102315 | 2/1983 |
| WO | 2001049455 | 7/2001 |
| WO | 2002011892 | 2/2002 |

* cited by examiner

SELF-POWERED PRESSURIZED GRANULAR PARTICLE EJECTOR TOOL WITH REMOTE OPERATION

BACKGROUND OF THE INVENTION

Various kinds and sizes of particulate abrasive delivery tools have been proposed in the past, including portable assemblies incorporating an abrasive hopper, a nozzle and a trigger for initiating the delivery of the abrasive stream, such as U.S. Pat. Nos. 4,941,298, 4,628,644, 3,163,963 and 2,133,149. However, each of these assemblies requires the addition of a remote source of compressed air or other pressurized driving gas to actuate the device.

Other proposals employ separate or remote hoppers of abrasive particles, such as U.S. Pat. Nos. 4,090,334 and 4,674,239, but again, these patents also employ remote sources of compressed air as the source of the driving fluid. German patent publication DE 3624023 Al proposes several different "portable sandblaster" devices incorporating a container of compressed propellant gas, but these proposals lack valuable features and important advantages of the present invention.

Additional hand held sandblasting devices such as those described in U.S. Pat. Nos. 5,514,026 and 5,181,349 also have a refillable hopper, which is attached to a pressurized propellant source which when operating allows pressure into and up one of two delivery conduits into a venture chamber, so that when operating, it will cause aspiration in which an additional conduit delivers abrasive particles into the mixing chamber and outward through a nozzle towards an intended target. This type of operational method of a sandblaster is very inefficient, as a majority of the device's pressure is used to generate the venture in the nozzle's chamber to aspirate abrasive material into the ventures via a pickup conduit into this chamber, where it is mixed with pressure blown out of the exiting nozzle with little strength.

SUMMARY OF THE INVENTION

The present invention provides a hand-held ejector tool incorporating a supply hopper of abrasive particulate material, a self-contained source of pressure, an internal intermixing regulator, and a replaceable and serviceable delivery nozzle located at the end of a remote, hand-held stylus housing having a delivery conduit and a control valve or trigger, thus forming a unitary portable and symmetrically balanced hand tool that can be transported conveniently in one hand to the site of operation. A simple trigger mechanism is used to initiate a one-way pressurized air flow carrying abrasive particulate material through the pressurized hopper where abrasive material is introduced into the pressurized stream via an intermix device that regulates the ratio of abrasive particles to pressure flow in the stream. The stream is ejected out of the hopper and by pressurizing the hopper, a delivery stream of abrasive particles is forced through a conduit. The conduit may be included in the hand-held stylus, which can be directed at a precise target location, using only one hand and avoiding any need for two hand operation, or remote compressed air cylinders or any separate components whatsoever.

Accordingly, a principal object of the present invention is to provide a unitary portable and self-powered pressurized granular particle ejector tool combining the supply of granular particles with all components required for their delivery at the desired location.

Still another object of the invention is to provide such a unitary portable ejector tool, in which the supply hopper can be separated and detached from the propellant source without losing pressure gained from the propellant source, due to an inline one way automatic pressure control valve, thus allowing the replacement of the pressurized propellant source without leakage from the pressurized hopper.

A further object of the invention is to provide such a unitary portable ejector tool capable of convenient separation into a refillable and reusable compressed gas propellant container, and a detachable assembly incorporating a refillable supply hopper containing a control device for the directional flow of pressurized granular particulate material to be ejected. The amount of abrasive particles contained in this directional pressurized flow is regulated by an internal pickup delivery tube of the hopper that contains a intermix vent allowing the regulation of the ratio of abrasive particles and pressurized gas. Without such a device regulating the ratio of materials, the abrasive material contained in the hopper will simply be driven out through the delivery conduit without any power to propel the stream.

Other objects and advantages of the present invention include: providing a remote nozzle, which with each of its internal parts, is serviceable and replaceable; providing material and pressure flow adjustability with the same hand that is operating the tool to allow the material flow to better meet the needs of the project being accomplished; providing for material flow adjustability so as to limit the release of excessive abrasive material; providing a hopper that can be pressurized and includes an abrasive material/pressure flow intermix device regulating a pressurized flow with an abrasive particle ratio achieving optimal abrasive effectiveness; providing an internal one-way pressure control valve allowing the removal of the hopper for changing of the propellant can without the discharge of pressure from the hopper; providing a specially designed removable pressure sealable filler plug, mounted on top of the reservoir chamber, as to provide for refilling the material repository easily and conveniently when the hopper is depressurized; and providing a female adapter chamber attached to the material reservoir chamber which can receive a breakable male adaptor/actuator pin that will activate any approved propellant can such that all cans will fit positively and propellant can manufacturers will not be able to substitute their own propellant cans, which can be hazardous.

The invention accordingly comprises the features of construction, combinations of elements, and arrangements of parts which will be exemplified in the constructions hereinafter set forth, and the scope of the invention will be indicated in the claims.

Accordingly, the refillable, serviceable, pressurized, adjustable nature of this invention, coupled with the increased pressure at the nozzle due to the pressurization of the hopper and coupled with its internal intermix of abrasive particles and pressure, controlled by the control valve located in the stylus will provide superior strength over Venturi operated tools and will provide the user with a tool that can: be used repeatedly in continuing glass carving projects because of its reusable and refillable nature; permit the abrasive/pressurized air flow mix to be adjusted and precisely delivered to the exiting nozzle assembly depending on the needs of the project and the material being sprayed; allow the user to precisely control and regulate the flow of abrasive particles by the use of a one hand controllable control valve which restricts abrasive flow to the consumer's needs when engaged in highly detailed engraving designs requiring shading in certain areas; expand usage for rust removal through the substantial increased pressure at the exiting nozzle; be easily refilled by the simple removal of the filler plug, by having an internal one-way control valve so that one can remove the pressurized hopper while being fully pressurized without any pressure lost to changing the pressure source; be positively attached to the approved aerosol can to provide for environmental and personal safety; and provide superior pressure and abrasive force greater than other hand-held devices allowing for the texturing of metal, e.g., the reconditioning and retexturing of "club faces" of sporting golf clubs for regaining texture lost due to common use and normal wear.

The pressurized utility device of the present invention incorporates a safety component used in the activation of the pressure valve of the pressurized power source. This device can be disposable and resupplied with every new pressurized propellant can as to prevent the consumer from using improper or non-recommended pressurized propellant cans.

The description above should not be construed as limiting the scope of the invention but as merely providing illustrations of some of the presently preferred uses of this invention.

In accordance with a first aspect of the invention, an apparatus having a hopper assembly is provided. The hopper assembly includes a containment area configured to store an abrasive material in a lower portion of the containment area. The hopper assembly also comprises an air conduit configured to receive pressurized air from a pressurized air source and a one-way valve in fluid communication with the air conduit and configured to provide the pressurized air into an upper portion of the containment area. The hopper assembly further comprises a mixing device comprising a conduit, the conduit extending into the containment area and comprising a first opening into the lower portion of the containment area that is configured to intake abrasive material and a second opening into the upper portion of the containment area that is configured to intake the pressurized air, wherein the mixing device is configured to mix the abrasive material and the pressurized air to create a pressurized stream of abrasive material for ejection through an exhaust nozzle.

In accordance with an embodiment of the apparatus of the first aspect of the invention, the hopper assembly comprises an upper hopper assembly section and a lower hopper assembly section comprising the air conduit. The upper hopper assembly section and the lower hopper assembly section are affixed and sealed together to form the containment area.

In accordance with a further embodiment of the apparatus of the first aspect of the invention, the hopper assembly further comprises a filler hole through an outer wall of the hopper assembly that permits filling the containment area of the hopper assembly with the abrasive material, and a cap configured to be received in and close the filler hole.

In accordance with a further embodiment of the apparatus of the first aspect of the invention, the hopper assembly further comprises a housing chamber at an end of the air conduit that is configured to connect the air conduit of the hopper assembly to the pressurized air source. In one such embodiment, the housing chamber is threaded and is configured to connect a canister or container of pressurized air having a corresponding threaded section to the air conduit of the hopper assembly, and comprises a valve actuator configured to actuate a release valve of the canister or container of pressurized air. The valve actuator may be a butterfly actuator pin comprising an actuator pin configured to actuate the valve of the canister or container of pressurized air and a cutaway area that is configured to allow the pressurized air to enter the air conduit from the canister or container of pressurized air. In a further such embodiment, the housing chamber is threaded and is configured to connect the air conduit to an air supply base configured to supply the pressurized air from a pressurized air source.

In accordance with a further embodiment of the apparatus of the first aspect of the invention, the one-way valve is configured to permit a flow of pressurized air from the air conduit into the containment area and is configured to prevent a flow of pressurized air from the containment area into the air conduit, such that pressurized air in the containment area does not escape the hopper assembly through the one-way valve or air conduit.

In accordance with a further embodiment of the apparatus of the first aspect of the invention, the one-way valve comprises a filter adjacent to the containment area configured to prevent the abrasive material from entering the one-way valve.

In accordance with a further embodiment of the apparatus of the first aspect of the invention, the first opening of the conduit of the mixing device that is configured to intake abrasive material has a first diameter, the second opening of the conduit of the mixing device that is configured to intake pressurized air has a second diameter, and the first diameter of the first opening of the conduit of the mixing device is greater than the second diameter of the second opening of the conduit of the mixing device. The mixing device may further comprise a cap configured to be inserted through an opening in an outer wall of the hopper assembly and a mounting housing configured to be inserted through the cap comprising a first end configured to be attached to the conduit of the mixing device and a second end configured to be attached to a delivery conduit to the exhaust nozzle.

In accordance with a further embodiment of the apparatus of the first aspect of the invention, the mixing device is configured to be attached to a delivery conduit received by a stylus comprising the exhaust nozzle, and the stylus is configured to permit a controllable ejection of the pressurized stream of abrasive material.

In accordance with a second aspect of the invention, an apparatus is provided comprising a pressurized air source, a hopper assembly and a delivery conduit. The hopper assembly comprises a containment area configured to store an abrasive material in a lower portion of the containment area, an air conduit configured to receive pressurized air from a pressurized air source, a one-way valve in fluid communication with the air conduit and configured to provide the pressurized air into an upper portion of the containment area, and a mixing device comprising a conduit, the conduit extending into the containment area and comprising a first opening into the lower portion of the containment area that is configured to intake abrasive material and a second opening into the upper portion of the containment area that is configured to intake the pressurized air, wherein the mixing device is configured to mix the abrasive material and the pressurized air to create a pressurized stream of abrasive material. The delivery conduit comprises a flexible tube having a first end connected to the mixing device and configured to receive the pressurized stream of abrasive material and a second end received by a stylus comprising an exhaust nozzle and configured to permit a controllable ejection of the pressurized stream of abrasive material.

In accordance with an embodiment of the apparatus of the second aspect of the invention, the hopper assembly further comprises a housing chamber at an end of the air conduit that is configured to connect the air conduit of the hopper assembly to the pressurized air source. In one such embodiment, the housing chamber is threaded and is configured to connect a canister or container of pressurized air having a corresponding threaded section to the air conduit of the hopper assembly, and comprises a valve actuator configured to actuate a release valve of the canister or container of pressurized air. The valve actuator can be a butterfly actuator pin comprising an actuator pin configured to actuate the valve of the canister or container of pressurized air and a cutaway area that is configured to allow the pressurized air to enter the air conduit from the canister or container of pressurized air. In a further such embodiment, the housing chamber is threaded and is configured to connect the air conduit to an air supply base configured to supply the pressurized air from a pressurized air source.

In accordance with a further embodiment of the apparatus of the second aspect of the invention, the one-way valve is configured to permit a flow of pressurized air from the air conduit into the containment area and is configured to prevent a flow of pressurized air from the containment area into the air conduit, such that pressurized air in the containment area does not escape the hopper assembly through the one-way valve or air conduit.

In accordance with a further embodiment of the apparatus of the second aspect of the invention, the first opening of the conduit of the mixing device that is configured to intake abrasive material has a first diameter, the second opening of the conduit of the mixing device that is configured to intake pressurized air has a second diameter, and the first diameter of the first opening of the conduit of the mixing device is greater than the second diameter of the second opening of the conduit of the mixing device.

In accordance with a further embodiment of the apparatus of the second aspect of the invention, the stylus comprises: a body section configured to receive the delivery conduit, the exhaust nozzle configured to eject the pressurized stream of abrasive material; and a control lever configured to control the ejection of the pressurized stream of abrasive material through the exhaust nozzle. The control lever is configured to pivot between a first position in which the control lever restricts a flow of the pressurized stream of abrasive material through the delivery conduit and a second position in which the control lever does not restrict the flow of the pressurized stream of abrasive material through the delivery conduit.

DETAILED DESCRIPTION OF THE FIGURES

The present invention will now be described with reference made to FIGS. 1-12D.

Figure 1:
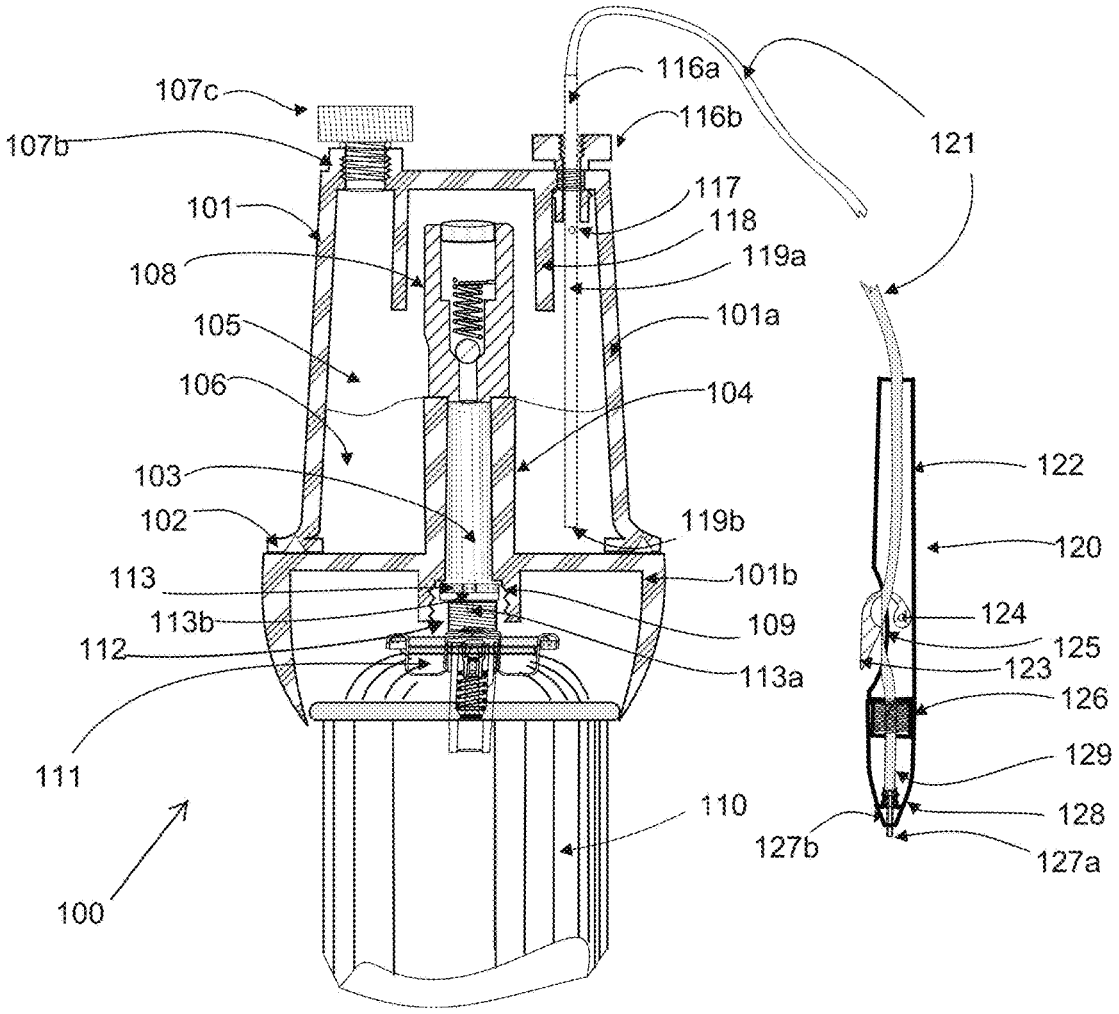
FIG. 1 shows a first view of the hand-held ejector apparatus in accordance with an embodiment of the invention.
Figure 2:
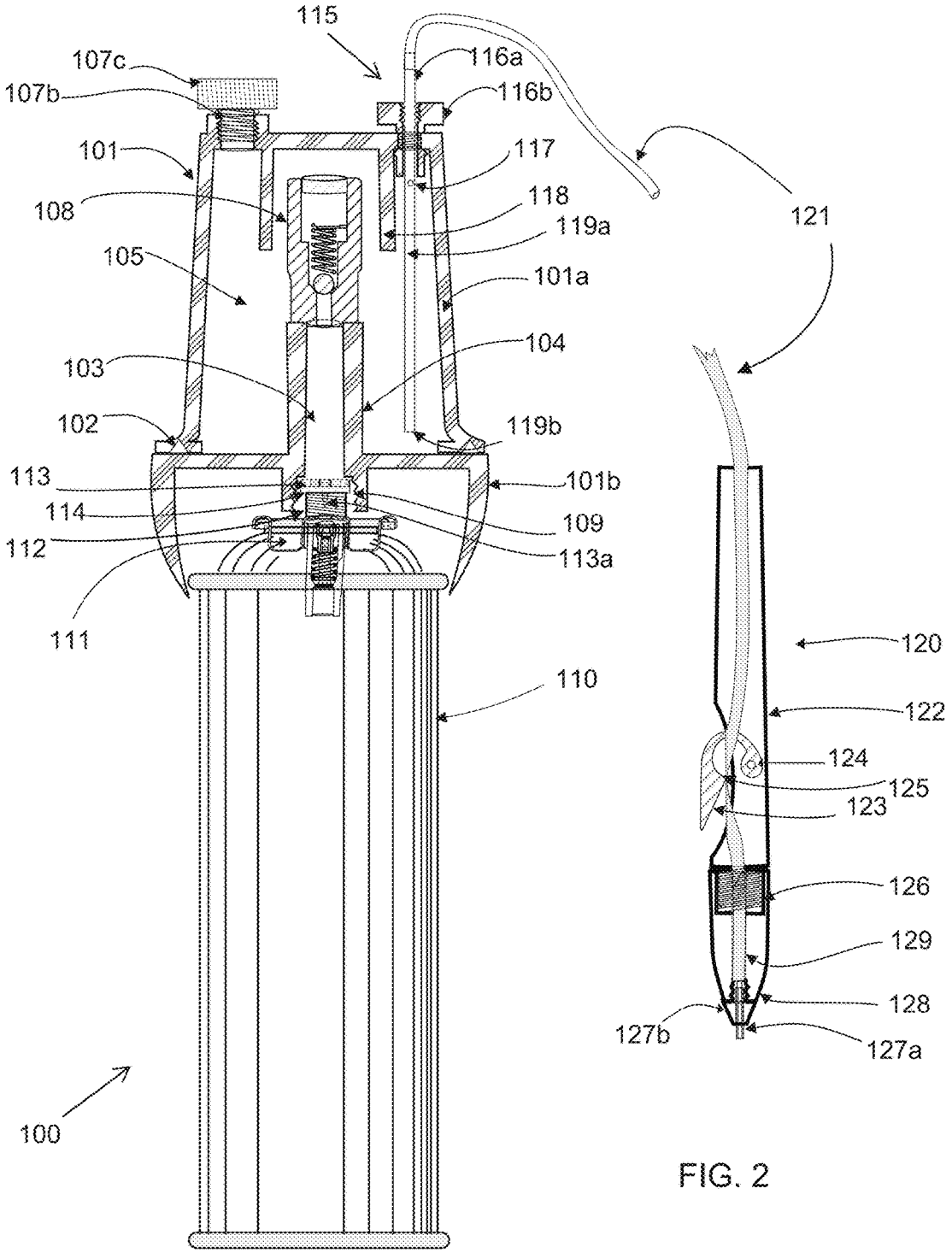
FIG. 2 shows a second view of the hand-held ejector apparatus in accordance with an embodiment of the invention.
Figure 3:
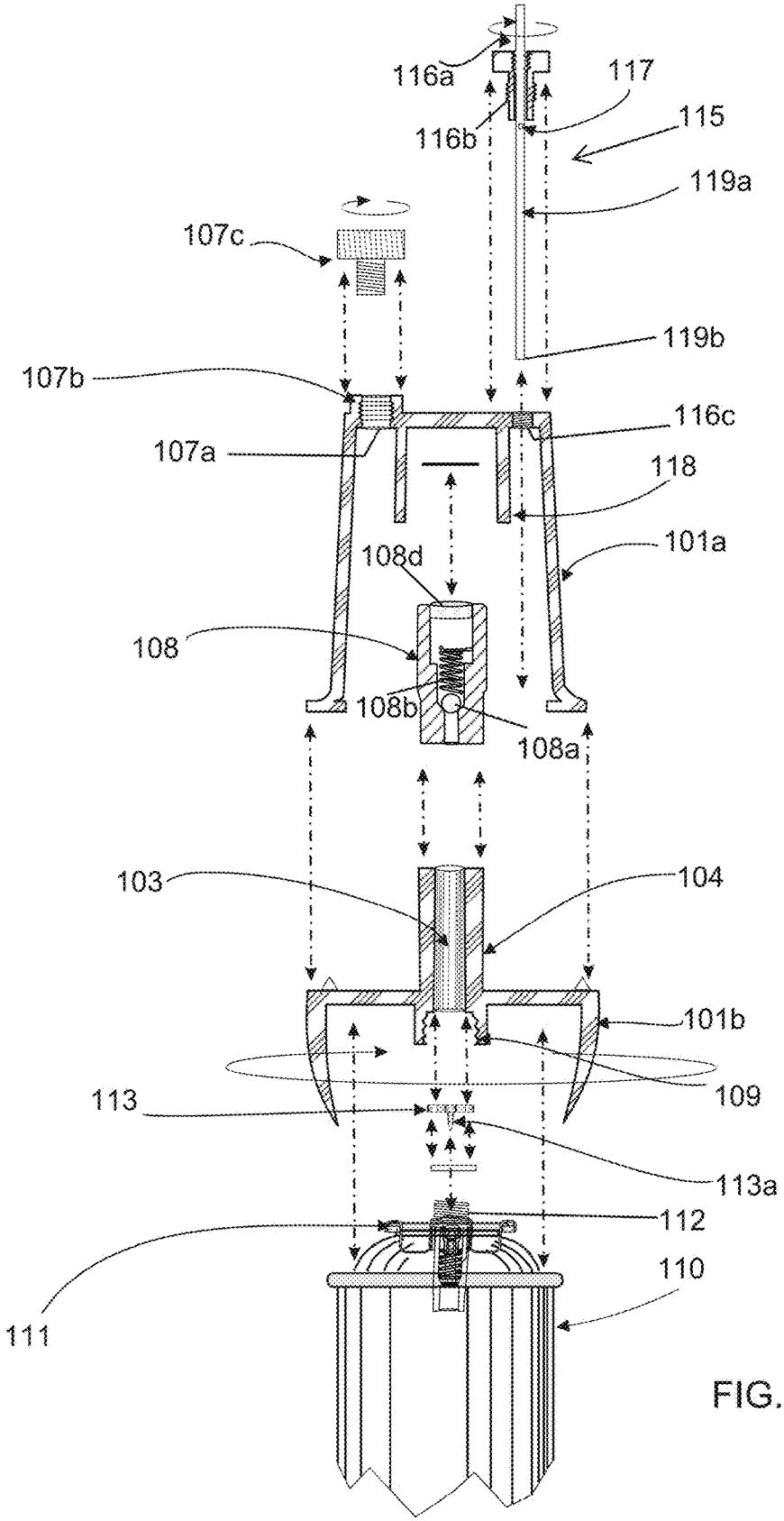
FIG. 3 shows an exploded view of the hopper assembly and pressure source of the hand-held ejector apparatus in accordance with an embodiment of the invention, in which the dashed arrows illustrate the assembly of the hopper assembly and attachment to the pressure source.
Figure 4A:
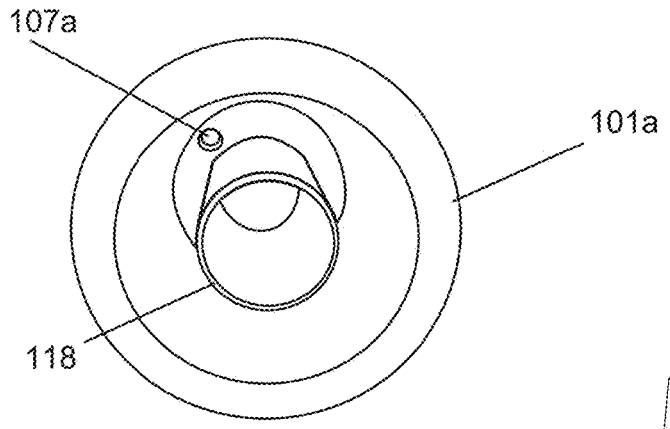
FIG. 4A shows the upper portion of the hopper assembly of the hand-held ejector apparatus in accordance with an embodiment of the invention.
Figure 4B:
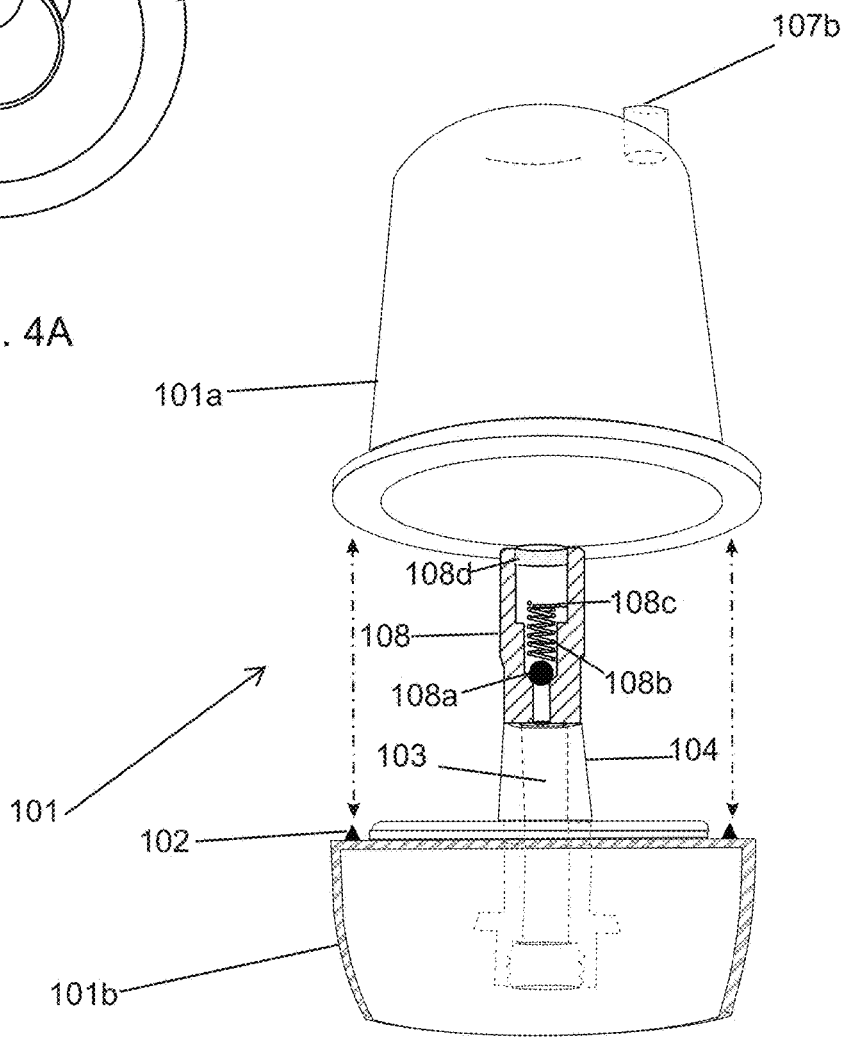
FIG. 4B shows an exploded view of the hopper assembly of the hand-held ejector apparatus in accordance with an embodiment of the invention, in which the dashed arrows illustrate the assembly of the hopper assembly.
Figure 5:
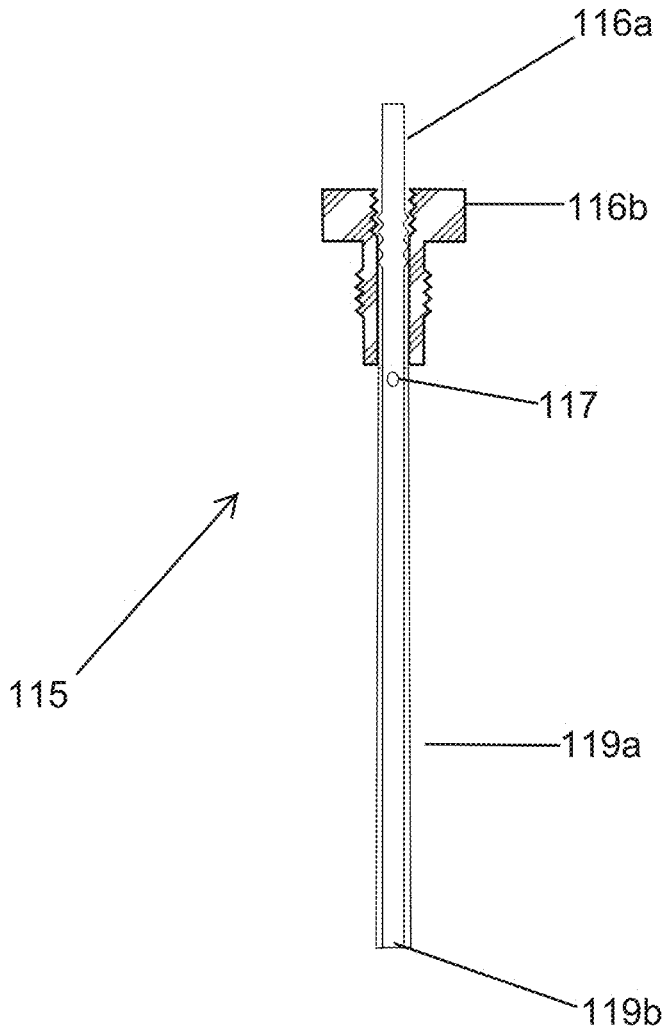
FIG. 5 shows a view of the intermix device of the hand-held ejector apparatus in accordance with an embodiment of the invention.
Figure 6A:
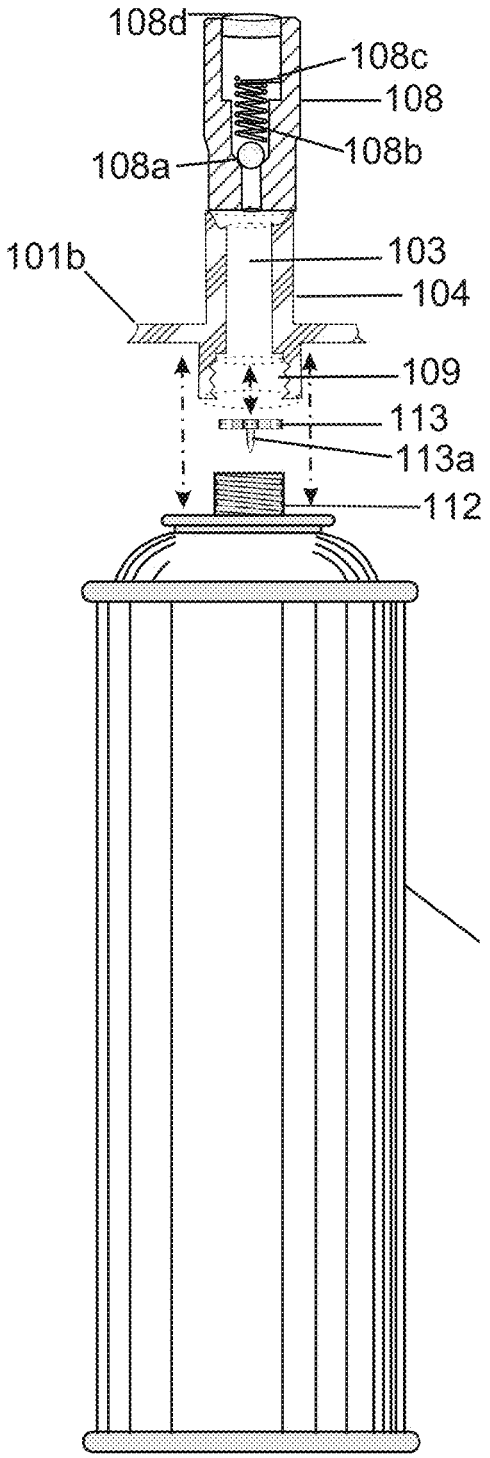
FIG. 6A shows an exploded view of the pressure source and control valve assemblies of the hand-held ejector apparatus in accordance with an embodiment of the invention in which the dashed arrows illustrate the assembly of the hopper assembly to the pressure source.
Figure 6B:
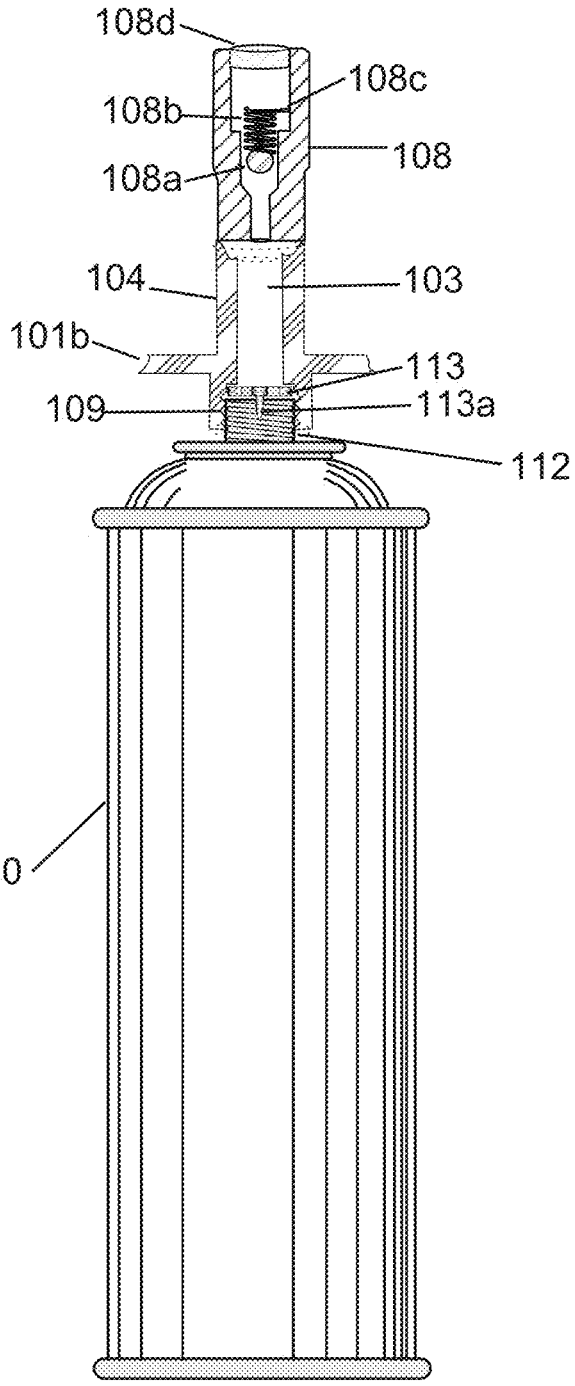
FIG. 6B shows a further view of the pressure source and control valve assemblies of the hand-held ejector apparatus in accordance with an embodiment of the invention.
Figure 7C:
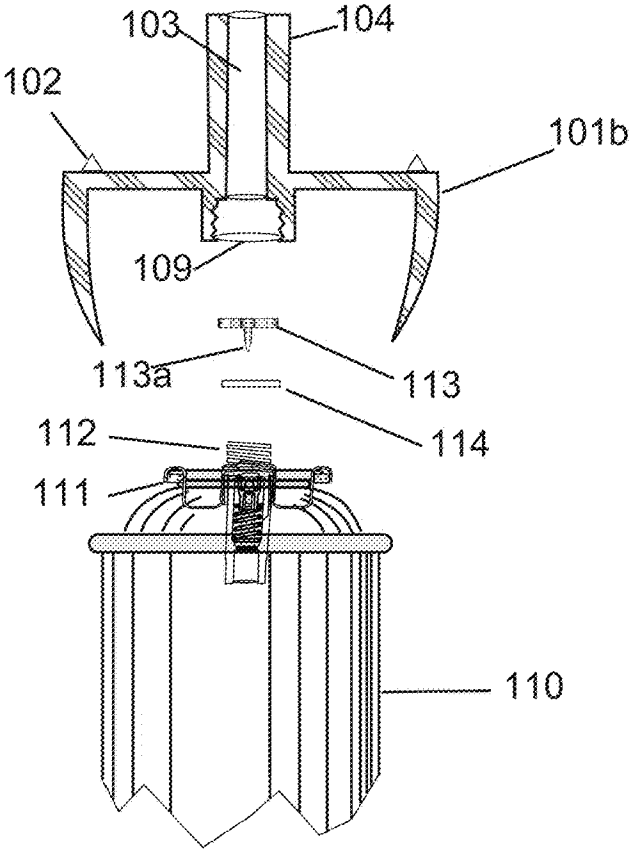
FIG. 7C shows a further, exploded view of the pressure source and control valve assemblies of the hand-held ejector apparatus in accordance with an embodiment of the invention.
Figure 7B:
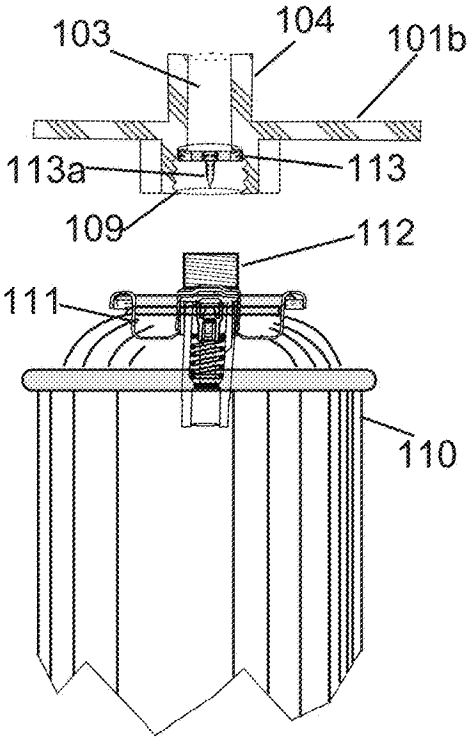
FIG. 7B shows a further, exploded view of the pressure source and control valve assemblies of the hand-held ejector apparatus in accordance with an embodiment of the invention.
Figure 7A:
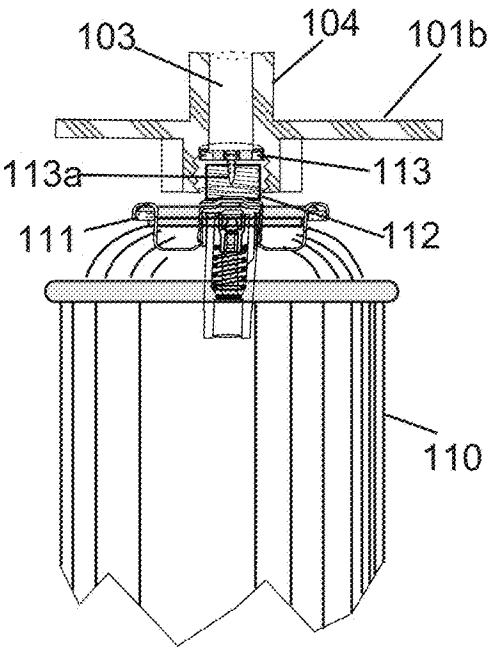
FIG. 7A shows a further view of the pressure source and control valve assemblies of the hand-held ejector apparatus in accordance with an embodiment of the invention.
Figure 8A:
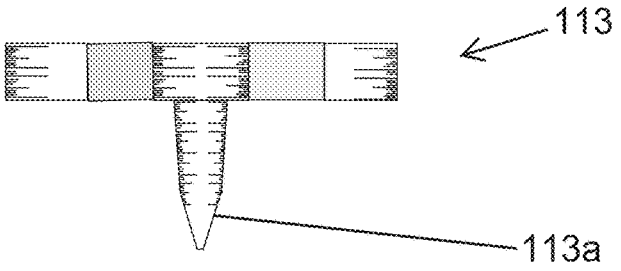
FIG. 8A shows a first view of the valve actuator of the hand-held ejector apparatus in an open position in accordance with an embodiment of the invention.
Figure 8B:
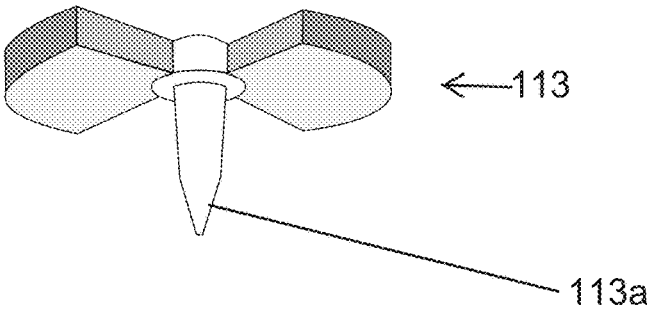
FIG. 8B shows a second view of the valve actuator of the hand-held ejector apparatus in an open position in accordance with an embodiment of the invention.
Figure 8C:
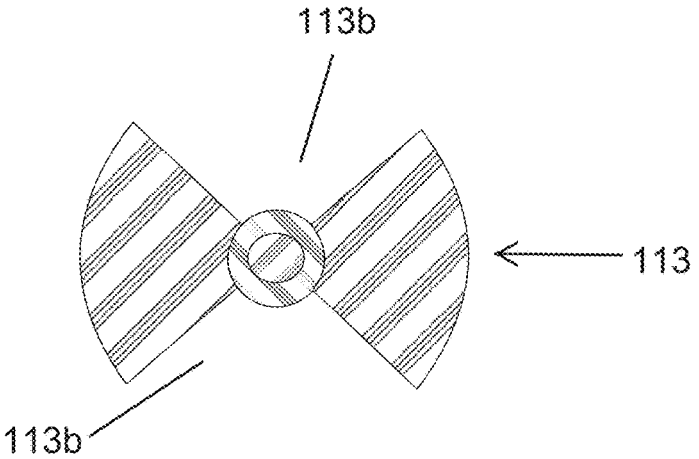
FIG. 8C shows a third view of the control valve assembly of the hand-held ejector apparatus in an open position in accordance with an embodiment of the invention.

As illustrated in FIGS. 1 and 2, a hand-held ejector tool 100 for ejecting a pressurized stream comprising an abrasive material 106 is provided. The ejector tool 100 includes a hopper assembly 101 storing the abrasive material 106, a pressure source 110, 210, such as a container 110 having pressurized or compressed air or an air supply base 210 connected to a pressurized air source, and a stylus 120, through which the pressurized stream of abrasive material 106 is ejected. Pressurized air is mixed with the abrasive material 106 in an intermix or mixing device 115 inside the hopper assembly 101 to create the pressurized stream that can be ejected from the stylus 120 using a control lever 123, or another delivery nozzle. In a preferred embodiment, the abrasive material hopper 101 of the tool 100 operates at positive pressure, with an operational range of between 45 and 75 PSI. As used herein, "pressurized air" or "compressed air" may refer to any pressurized or compressed gas, particularly those suitable for use as a propellant. The "abrasive material" used in connection with the present invention can include any abrasive material, including granular particulate matter, that is known in the art. In one embodiment of the present invention, the abrasive material 106 used is aluminum oxide, which is a man-made material that is 100% inert, anti-allergenic, and environmentally safe. Other embodiments of the present invention may dispense materials from the hopper assembly 101 such as sand, fine powder materials such as sugar or flour, or liquids.

In an exemplary embodiment shown for example in FIGS. 1-4, the hopper assembly 101 comprises two sections, an upper hopper assembly 101*a* and a lower hopper assembly 101*b*. The upper hopper assembly 101*a* is equipped with a filler hole 107*a* and an opening 116*c* for receiving the intermix device 115, as well as containment walls 118, which are oriented inside the assembled hopper assembly 101. The lower hopper assembly 101*b* may comprise the central axial pressurized air delivery conduit 103 and the internal support walls 104 for the central axial pressurized air delivery conduit 103, as well as a threaded actuator valve housing chamber 109 configured to attach the hopper assembly 101 to the pressure source 110, 210. The upper hopper assembly 101*a* and lower hopper assembly 101*b* can be sealed together to form the closed hopper assembly in a number of ways, including by sonically welding the upper hopper assembly 101*a* and lower hopper assembly 101*b* at a joint 102. The welding together of the upper hopper assembly 101*a* and lower hopper assembly 101*b* defines a containment area 105 inside the hopper assembly 101, that is configured to receive and store the abrasive material 106 in a lower portion of the containment area 105. The lower hopper assembly 101*b* includes an upper surface around the base of the internal support walls 104 that substantially closes the open, base portion of the upper hopper assembly 101*a*, except for an opening through the central axial pressurized air delivery conduit 103. The hopper assembly 101 can be constructed and assembled in alternative manners than that shown in the Figures without deviating from the scope of the invention.

In the assembled hopper assembly 101, the internal support walls 104 for the central axial pressurized air delivery conduit 103, which project from an upper surface of the lower hopper assembly 101*b* and extend into the containment area 105. A one-way control valve 108 is placed atop the internal support walls 104, such that the one-way control valve 108 is in fluid communication with the central axial pressurized air delivery conduit 103 and can receive pressurized air through central axial pressurized air delivery conduit 103. The one-way control valve 108 may extend into an area in an upper portion of the containment area 105, within the containment walls 118 projecting from the upper hopper assembly 101*a* for redirection of pressure and abrasive matter. The hopper assembly 101 includes an opening 116*c* that is configured to receive an intermix device 115, which is shown for example in FIG. 5. This opening 116*c* may be threaded so as to receive a threaded cap or screw 116*b* of the intermix device 115, but in other embodiments may not be threaded and the cap or screw 116*b* may also not be threaded. The intermix device 115 includes a conduit 119*a* that extends into the containment area 105 of the hopper assembly 101. The conduit 119*a* of the intermix device 115 includes an air pressure inlet control vent 117 positioned inside the containment area 105 in an upper portion of the containment area 105, and an inlet 119*b* at the end of the conduit 119*a* that is configured to intake the abrasive material 106 that is stored in the lower portion of the containment area 105.

The hopper assembly 101 comprises a filler hole 107*a* that allows the operator to fill or refill the containment area 105 with abrasive material 106 or another material. The filler hole 107*a* may include a threaded seat 107*b* that is configured to receive a threaded cap 107*c*. The threaded cap 107*c* can be removed from the filler hole 107*a* when the containment area 105 needs to be refilled, and securely inserted into the filler hole 107*a* to prevent the leakage of the abrasive material 106.

The hopper assembly 101 is further configured so that it can be disconnected from the pressure source 110, 210 without losing any pressure that has built up in the containment area 105. The hopper assembly 101 can be secured to the container 110 by inserting a threaded valve 112 of the container 110 into the actuator valve housing chamber 109 of the lower hopper assembly 101*b*, which is threaded so as to be connectable to the threaded valve 112, as shown for example in FIGS. 6A-6B and 7A-7C. Once the container 110 is secured to the hopper assembly 101, pressurized air can travel from the container 110 into the hopper assembly 101 through the central axial pressurized air delivery conduit 103 and the one-way control valve 108. If the container 110 of pressurized air needs to be replaced, it must be detached from the hopper assembly 101. It is preferable that when the hopper assembly 101 is detached from the container 110, none of the pressurized air and abrasive material 106 that remains in the containment area 105 of hopper assembly 101 escapes out of the hopper assembly 101. The one-way control valve 108 is configured to prevent the backflow of pressurized air or other contents of the hopper assembly 101 into the central axial pressurized air delivery conduit 103 through which the pressurized air entered the hopper assembly 101. The one-way valve 108 can be attached to the hopper assembly 101, for example, by screwing the one-way valve 108 onto the central axial pressure delivery conduit 103, or in embodiments where the one-way valve 108 is made of plastic, it can be solvent welded as a permanent attachment to the hopper assembly 101.

Figure 9A:
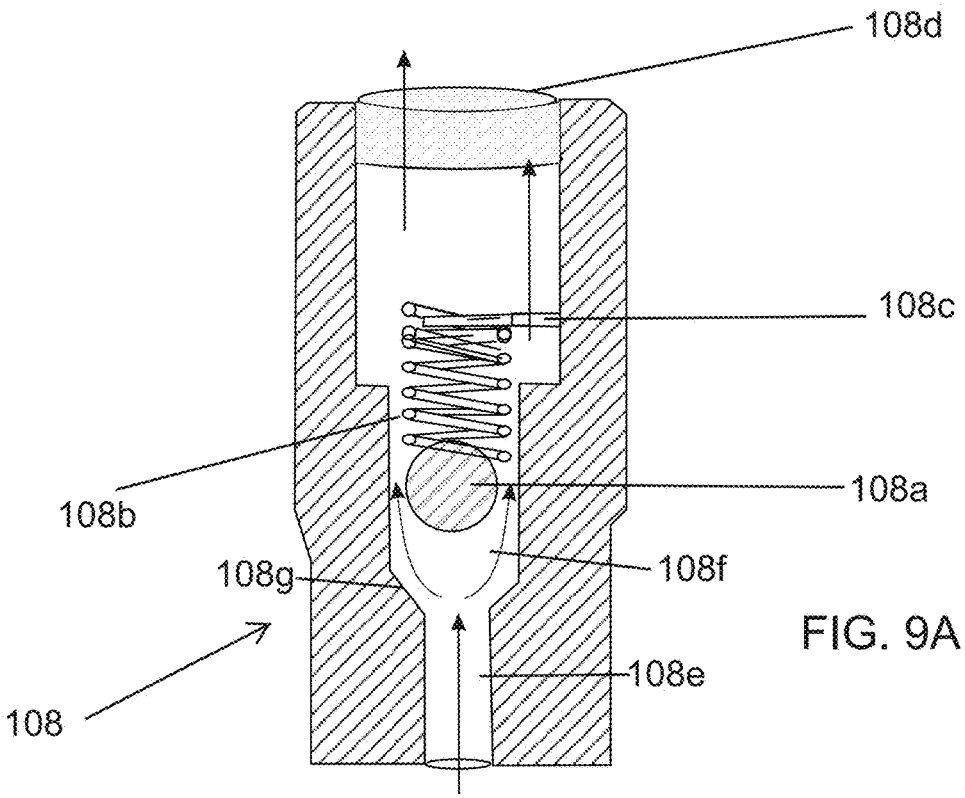
FIG. 9A shows a first view of the control valve assembly of the hand-held ejector apparatus in a closed position in accordance with an embodiment of the invention.
Figure 9B:
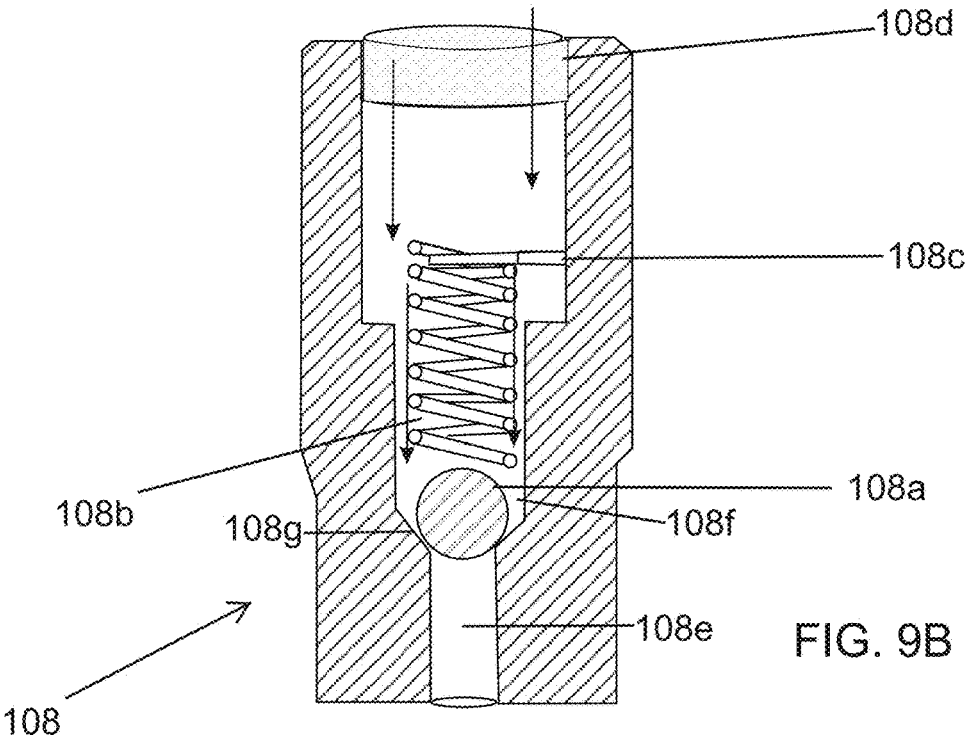
FIG. 9B shows a second view of the control valve assembly of the hand-held ejector apparatus in an open position in accordance with an embodiment of the invention.
Figure 10A:
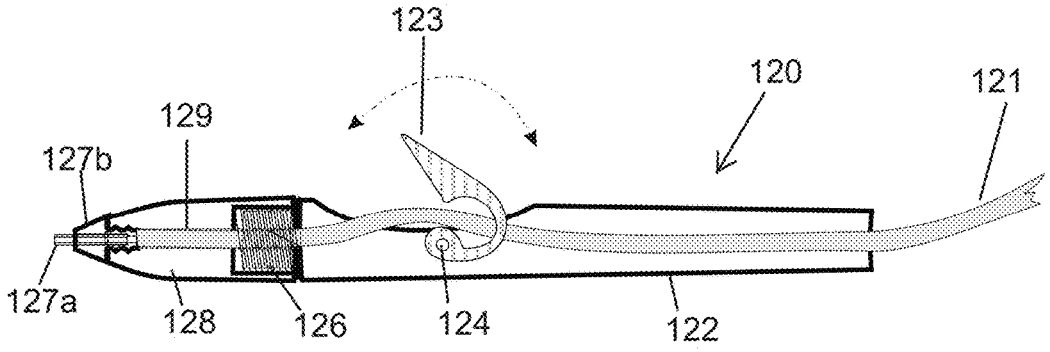
FIG. 10A shows the hand-held stylus of the hand-held ejector apparatus in an open position in accordance with an embodiment of the invention.
Figure 10B:
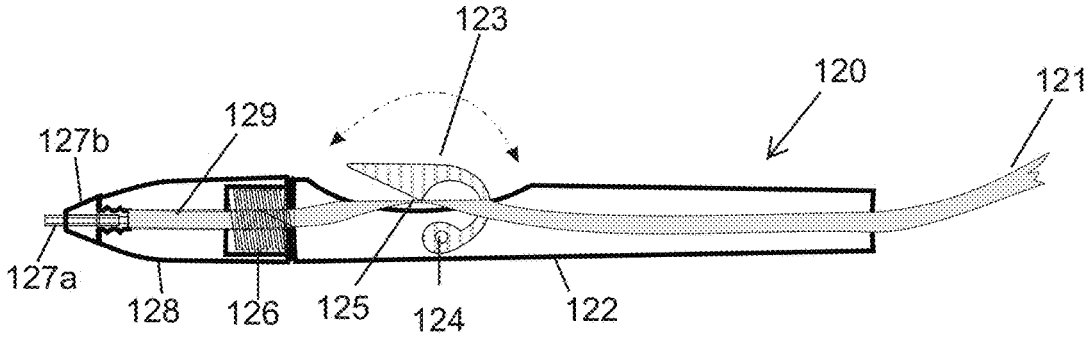
FIG. 10B shows the hand-held stylus of the hand-held ejector apparatus in a closed position in accordance with an embodiment of the invention.
Figure 11A:
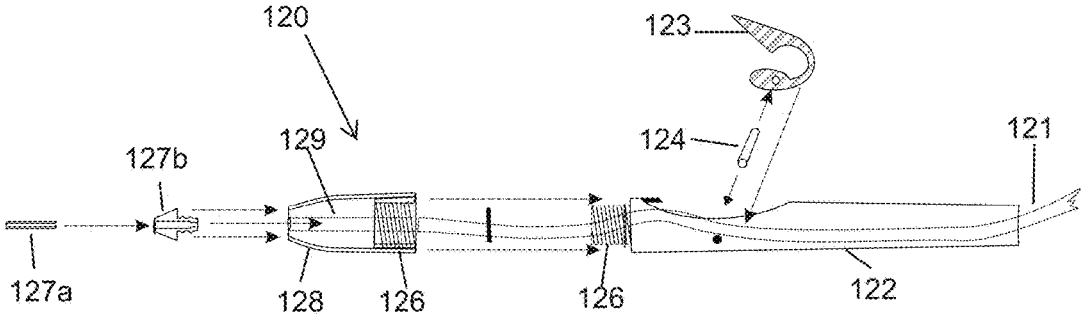
FIG. 11A shows a first exploded view of the hand-held stylus of the hand-held ejector apparatus in accordance with an embodiment of the invention.
Figure 11B:
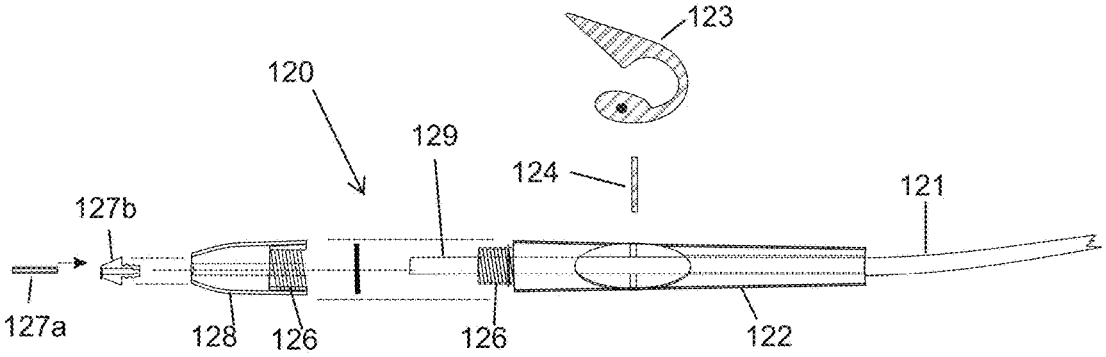
FIG. 11B shows a second exploded view of the hand-held stylus of the hand-held ejector apparatus in accordance with an embodiment of the invention.
Figure 12A:
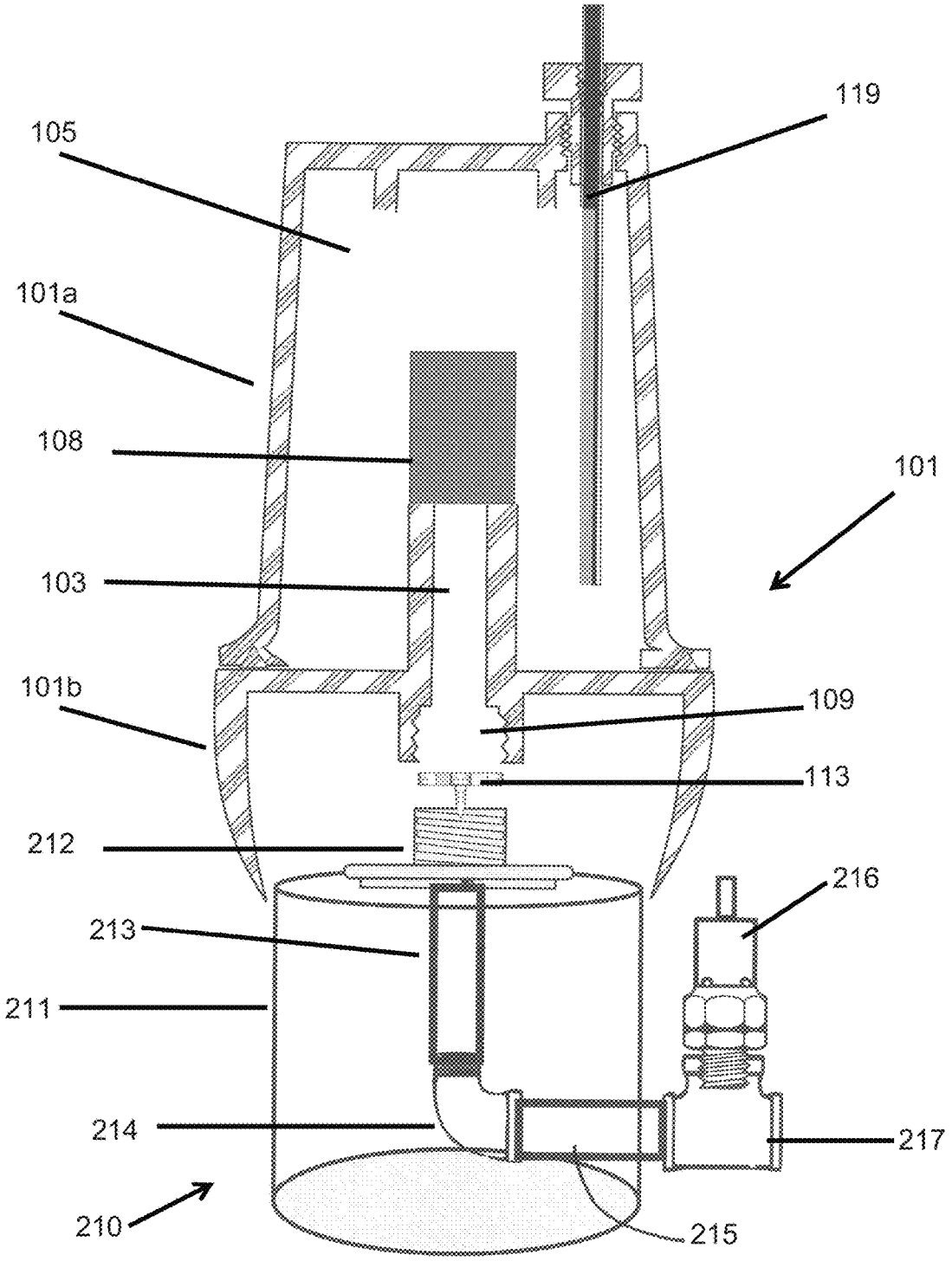
FIG. 12A shows a first, exploded view of a hand-held ejector apparatus in accordance with a further embodiment of the invention, comprising an air supply base.
Figure 12C:
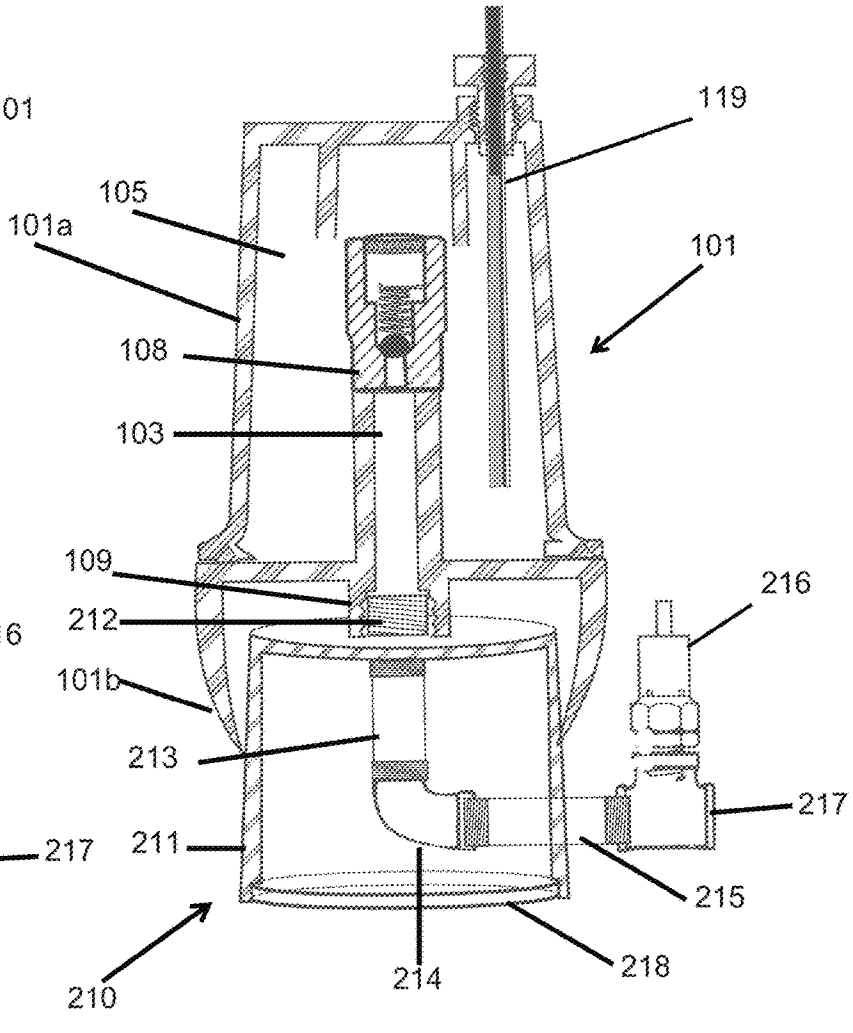
FIG. 12C shows a hand-held ejector apparatus in accordance with a further embodiment of the invention, comprising an air supply base.
Figure 12B:
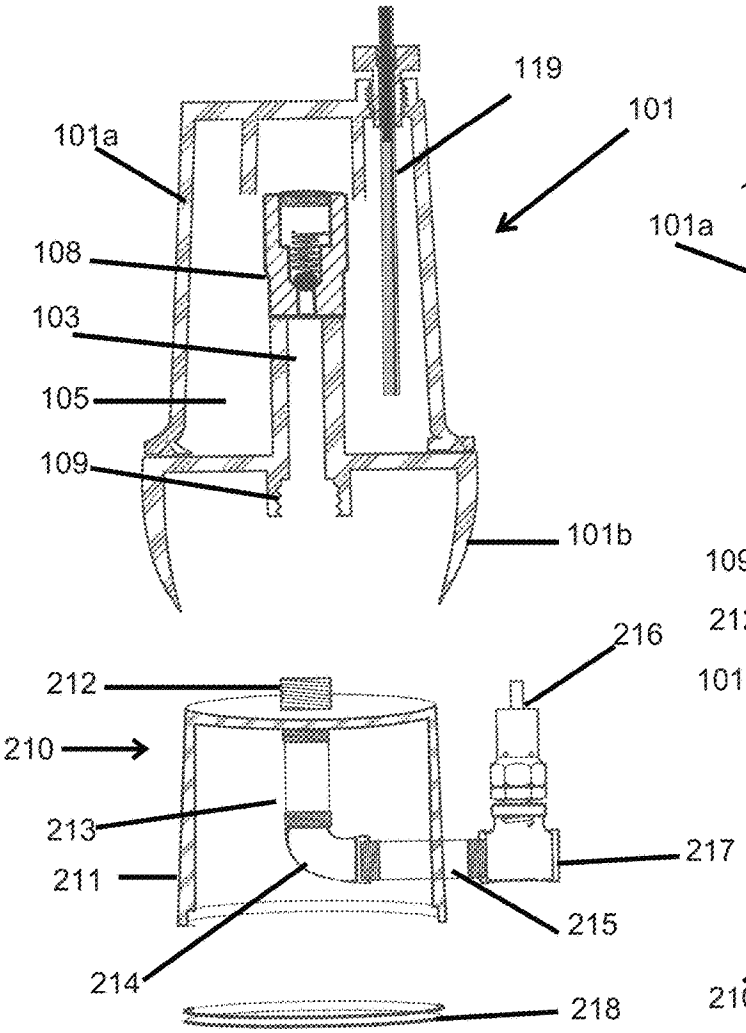
FIG. 12B shows a second, exploded view of a hand-held ejector apparatus in accordance with a further embodiment of the invention, comprising an air supply base.
Figure 12D:
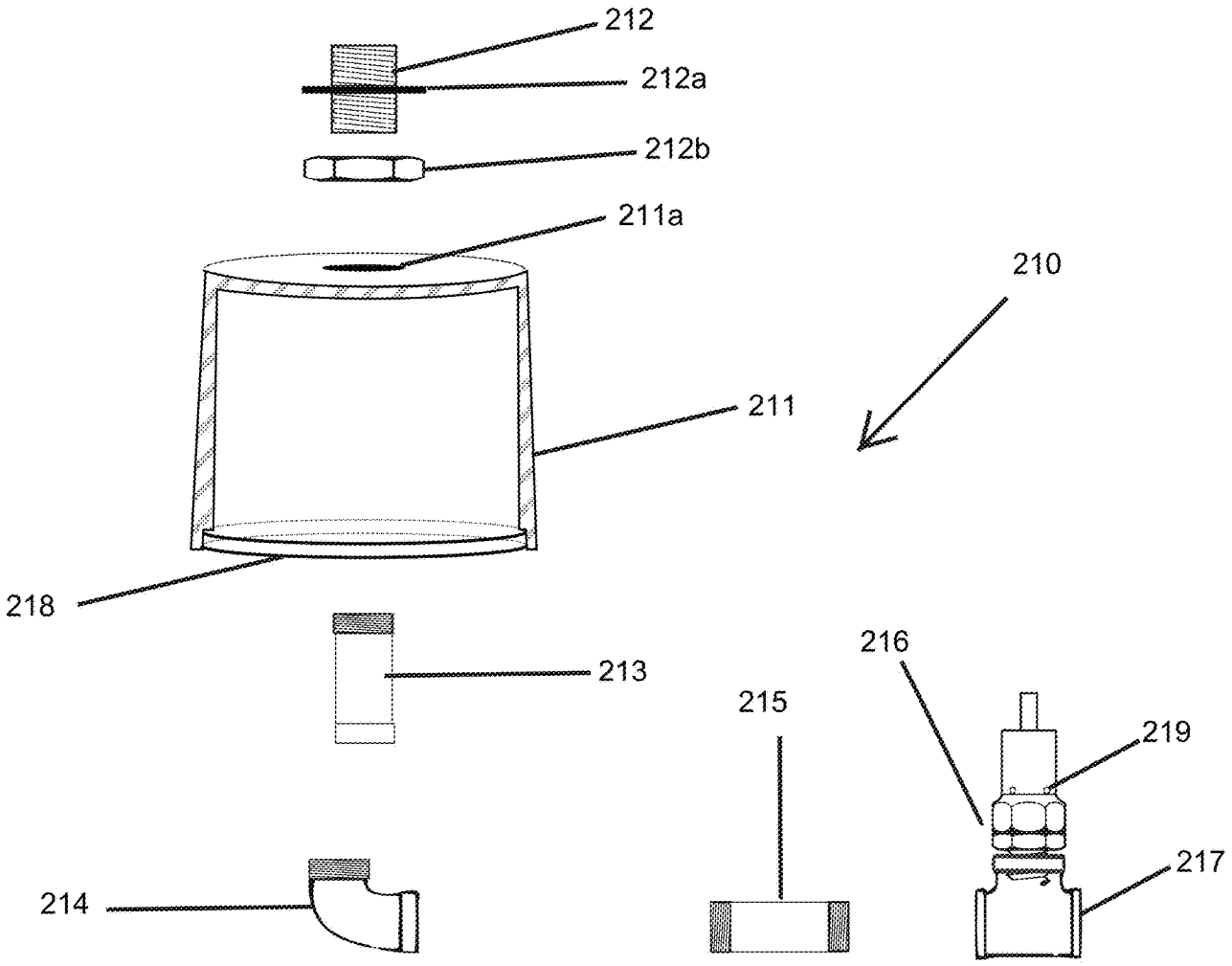
FIG. 12D shows an exploded view of an air supply base for use in a hand-held ejector apparatus in accordance with a further embodiment of the invention.

FIG. 9A illustrates the one-way control valve 108 when it is in an opened position, such as when pressurized air is entering the containment area 105 of the hopper assembly 101 from the container 110 and FIG. 9B illustrates the one-way control valve 108 when it is in a closed position. The one-way control valve 108 includes a ball valve 108*a* that is positioned adjacent to a first end of a spring 108*b*. The second and opposite end of the spring 108*b* is secured to a plate 108*c* that is configured to prevent any movement of the spring 108*b* past the plate 108*c*. The one-way control valve 108 may also comprise a filter 108*d*. The filter 108*d* can be attached to the top of the one-way valve 108 to prevent any abrasive material 106 from entering the one-way valve 108 and jamming or clogging the one-way valve 108. The one-way control valve 108 comprises a first passageway

108*e* at the end of the one-way control valve 108 that is adjacent to and in fluid communication with the central axial pressurized air deliver conduit 103. The first passageway 108*e* has a diameter that is less than the diameter of the ball valve 108*a*. A second passageway 108*f* of the one-way control valve 108 is in fluid communication with and adjacent to the first passageway 108*e*. The second passageway 108*f* has at least one diameter that is greater than the diameter of the ball valve 108*a*. The second passageway 108*f* may further comprise a frustoconical portion 108*g* at an end adjacent to the first passageway 108*e*, which is configured to hold the ball valve 108*a* when the one-way control valve 108 is closed.

When pressurized air enters the first passageway 108*e* of the one-way control valve 108, the pressurized air pushes the ball valve 108*a* out of the frustoconical portion 108*g* towards the spring 108*b*. This allows the pressurized air to pass into the second passageway 108*f*, and pass around the ball valve 108*a* and out of the one-way control valve 108 through the filter 108*d*, as illustrated in FIG. 9A. If the hopper assembly 101 is detached from the container 110, or there is otherwise no supply of pressurized air from the container 110 into the hopper assembly 101, the ball valve 108*a* rests in the frustoconical portion 108*g* and blocks passage between the second passageway 108*f* and the first passageway 108*e*, as illustrated in FIG. 9B. Even if pressurized air that remains in the hopper assembly 101 reenters the one-way control valve 108 through the filter 108*d*, such pressurized air is unable to dislodge the ball valve 108*a* from its position that blocks the first passageway 108*e*. As a result, when the hopper assembly 101 is detached from the container 110, pressurized air in the hopper assembly 101 cannot escape the hopper assembly 101 by exiting through the one-way control valve 108, through which the pressurized air entered the hopper assembly 101. The hopper assembly 101 is able to remain pressurized while it is disconnected from a container 110. This pressure within the hopper assembly 101 can be relieved by activating the hand held stylus 120 valve prior to refilling the hopper 101 with abrasive and only after being removed from the pressure source 110, 210.

In accordance with one embodiment of the invention, the pressure source that provides a source of pressurized air to the hand-held ejector tool 100 of the present invention can be a container 110 or canister of pressurized air, such as an aerosol can. The container 110 may be equipped with a mounting cover 111 and a threaded valve 112 that is affixed to the container 110. The container 110 may be a container or canister of pressurized air known in the art that is suitable for such purposes.

The actuator valve housing chamber 109 is configured to receive the threaded valve 112 of the container 110, and attach the container 110 to the hopper assembly 101. A valve actuator 113 may also be provided in the actuator valve housing chamber 109, which is shown for example in FIGS. 8A-8C. The valve actuator 113 is provided with an actuator pin 113*a* that is configured to puncture the threaded valve 112. The valve actuator 113 also includes a cutaway area 113*b*, that is configured to provide a path for the pressurized air to travel through from the container 110 into the central axial pressurized air deliver conduit 103. A sealing gasket 114 may be provided in between the valve actuator 113 and the threaded valve 112. The valve actuator 113 can be in the form of a breakable, butterfly activator pin, which is inserted into the base of the hopper 101 in order to activate the valve 112 when container 110 is tightened onto the hopper 101. This is designed for safety, as to prevent the user from applying an aerosol can that is not designed for the blaster, such as a "blow-off" pressure can.

An intermix device 115 is inserted into an opening 116*c* of the hopper assembly 101 and is configured to regulate the mixing of the abrasive material 106 in the hopper assembly 101 and pressurized air that enters the hopper assembly 101 from the container 110 to be used as a propellant for the abrasive material 106. The intermix device 115 includes a mounting housing 116*a* that extends out of the hopper assembly 101. The mounting housing 116*a* is configured to connect the conduit 119*a* of the intermix device 115 to a flexible delivery conduit 121 that is connected to a stylus 120 for ejecting the abrasive material 106 and pressurized air. The mounting housing 116*a* is connected to a threaded screw 116*b* of the intermix device 115. The threaded screw 116*b* may comprise an threaded passage through the center of the threaded screw 116*b* configured to receive the mounting housing 116*a*, which may also include an externally threaded portion. The threaded screw 116*b* also may include an externally threaded portion that is configured to be received by and secured to a threaded opening 116*c* of the hopper assembly 101 to secure the intermix device 115 to the hopper assembly 101. The intermix device 115 further includes a conduit 119*a* extending into the containment area 105 of the hopper assembly 101 comprising the abrasive material 106. An inlet 119*b* at the end of the conduit 119*a* is configured to intake abrasive material 106 into the conduit 119*a*, for delivery through the delivery conduit 121.

The conduit 119*a* of the intermix device 115 includes an inlet control vent 117 that is configured to intake pressurized air that enters the containment area 105 of the hopper assembly 101 from the container 110. The inlet control vent 117 is preferably incorporated into a top portion of the conduit 119*a*. The pressurized air that enters through the inlet control vent 117 of the intermix device 115 is mixed with the abrasive material 106 that has also entered the intermix device 115, to create a stream of abrasive material 106 that can be propelled from the stylus 120 connected to the delivery conduit 121. The inlet control vent 117 controls the amount of pressurized propellant (air) that is mixed into the abrasive stream propelled up the conduit 119*a*, and allows just enough air to prevent too much abrasive material 106 from being delivered to the hand held stylus 120. If too much abrasive material 106 is taken into the conduit 119*a* relative to the amount of pressurized air, the unit will not have enough pressure to blast its target's face. The inlet control vent 117 ensures the correct amount of abrasive material 106 to air is in the mixture. The inner diameter of the conduit 119*a* may be greater than the diameter for the inlet control vent 117. In one embodiment of the invention, the conduit 119*a* may have an inner diameter of approximately 0.125 inches to allow the abrasive material 106 to flow up the conduit 119*a*. The inlet control vent 117 may have a diameter of approximately 0.06 inches. Because the abrasive material 106 has a higher viscosity and weight, a force is required to drive the abrasive material 106 upwards through the conduit 119*a*. The inlet control vent 117 having a smaller diameter than the conduit 119*a* allows air pressure containing no abrasive material 106 to be forced into the stream of abrasive material 106 in the intermix device 115, creating a mixture of abrasive material 106 and propellant air.

The hand-held stylus 120 includes a body section 122 that is configured to receive and house the delivery conduit 121 carrying the stream of abrasive material 106 and pressurized air from the intermix device 115 and hopper assembly 101. The delivery conduit 121 may be made from a flexible material. An example of a stylus 120 according to an embodiment of the present invention is illustrated in FIGS. 10A-10B and 11A-11B. The stylus 120 comprises a control lever 123 that is configured to control the flow of the abrasive material air stream through the delivery conduit 121. The control lever 123 is configured to pivot about a mounting pin 124 that is inserted through the control lever 123 and body section 122, and mounts the control lever 123 to the body section 122. The control lever 123 is controllable by the operator of the hand-held ejector tool 100. The control lever 123 can be pivoted away from the delivery conduit 121, as illustrated for example in FIG. 10A. In this configuration, the abrasive material air stream can pass through the delivery conduit 121 and be ejected from the stylus 120. The control lever 123 can also be pivoted towards the delivery conduit 121, as illustrated for example in FIG. 10B, such that a restrictor point 125 on the control lever 123 compresses the delivery conduit 121 in a manner that blocks the abrasive material air stream from passing through the delivery conduit 121. Thus with the control lever 123, the operator can effectively turn on and off the abrasive material air stream.

The hand-held stylus 120 may include an exhaust nozzle conduit mounting retainer housing 128 that is separate from the body section 122 of the stylus 120. The body section 122 and the exhaust nozzle conduit mounting retainer housing 128 may comprise corresponding threaded sections 126 that permit the body section 122 and the exhaust nozzle conduit mounting retainer housing 128 to be attached and detached from each other. An exhaust nozzle conduit 127*a* can be inserted into an exhaust nozzle conduit adapter 127*b* that is attachable to the exhaust nozzle conduit mounting retainer housing 128. The exhaust nozzle conduit 127*a* and exhaust nozzle conduit adapter 127*b* are configured to be attached to an end section 129 of the delivery conduit 121. The exhaust nozzle conduit 127*a* may have a smaller diameter than the delivery conduit 121, so as to propel a more focused stream of the abrasive material air mixture.

Using a remote stylus 120 instead of holding the entire unit will provide maximum comfort to the user, and allow for maximum control of the blast nozzle to allow for high detail and precision, allowing the user to be able to provide shading to their artwork, similar to the use of an airbrush use by artists to control the density of the color applied whereas the user will be able to apply shading by controlling the blast density on the surface.

In alternative embodiments of the present invention, the delivery nozzle for ejecting the pressurized stream of abrasive material can vary from the stylus 120 attached to a flexible delivery conduit 121, as shown in FIGS. 10A-11C. For example, a delivery nozzle attached directly to the intermix device 115 or the hopper assembly 101 may also be utilized with the ejector tool 100 of the present invention.

The abrasive hopper unit 101 will have the ability to expand its capabilities by using an optional air supply base 210 as the pressure source instead of an aerosol container 110. An example of such an air supply base 210 is shown in FIGS. 12A-12D. The air supply base 210 can be set to a specific pressure insuring maximum safety to ensure the hopper 101 never exceeds the recommended operational pressure parameters.

An example of an air supply base 210 according to an embodiment of the present invention is illustrated in FIGS. 12A-12D. The air supply base 210 may comprise a housing 211. A top surface of the housing 211 may comprise a hole 211*a* therethrough, configured to receive a threaded tube 212. The threaded tube 212 may include two sections separated by a retainer collar 212*a*. An upper section of the threaded tube 212 may be configured to be attached to the hopper assembly 101 by threading the upper section of the threaded tube 212 into the actuator valve housing chamber 109. A valve actuator 113 may also be provided for use with the threaded tube 212 if a valve is contained within the threaded tube 212. A lower portion of the threaded tube 212 is configured to be connected to a pipe 213 having corresponding threaded sections. The pipe 213 can be housed inside the housing 211 and a retaining nut 212*b* can be provided between the retainer collar 212*a* and the top surface of the housing 211. In alternative embodiments of the air supply base 210, the threaded tube 212 or a similar member may be integrally formed with the housing 211.

Inside the housing 211, the pipe 213 may be attached to one end of an elbow pipe fitting 214. The opposite end of the elbow pipe fitting 214 is connected to a second pipe 215. The second pipe 215 may extend out of the housing 211 through a further hole (not shown). In one embodiment of the air supply base 210, the pipes 213, 215 and elbow pipe fitting 214 may have inner diameters of approximately 0.375 inches. The housing 211 may be provided with a detachable base section 218, which can be detached to permit access to the pipes 213, 215 and elbow pipe fitting 214.

The pipe 215 is connected to a pressure relief valve 216 positioned outside of the housing 211. The pressure relief valve 216 includes an air inlet 217 that is configured to be connected to an air source or to a hose connected to an air source. The pressure relief valve 216 also may include pressure relief vents 219. In a preferred embodiment, the pressure relief valve 216 can be set to approximately 72 PSI of pressure, but this amount may vary in alternative embodiments. Pressurized air can be supplied from the air source connected to the air supply base 210 to the hopper assembly 101 to create a pressurized stream of abrasive material 106, as previously described.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An apparatus comprising:

a hopper assembly comprising:

a containment area configured to store an abrasive material in a lower portion of the containment area;

an air conduit configured to receive pressurized air from a pressurized air source;

a one-way valve in fluid communication with the air conduit and configured to provide the pressurized air into an upper portion of the containment area; and a mixing device comprising a conduit, the conduit extending into the containment area and comprising a first opening into the lower portion of the containment area that is configured to intake abrasive material and a second opening into the upper portion of the containment area that is configured to intake the pressurized air, wherein the mixing device is configured to mix the abrasive material and the pressurized air to create a pressurized stream of abrasive material for ejection through an exhaust nozzle.

2. The apparatus according to claim 1, wherein the hopper assembly comprises:

an upper hopper assembly section; and a lower hopper assembly section comprising the air conduit;

wherein the upper hopper assembly section and the lower hopper assembly section are affixed and sealed together to form the containment area.

3. The apparatus according to claim 1, wherein the hopper assembly further comprises:

a filler hole through an outer wall of the hopper assembly that permits filling the containment area of the hopper assembly with the abrasive material; and a cap configured to be received in and close the filler hole.

4. The apparatus according to claim 1, wherein the hopper assembly further comprises:

a housing chamber at an end of the air conduit that is configured to connect the air conduit of the hopper assembly to the pressurized air source.

5. The apparatus according to claim 4, wherein the housing chamber is threaded and is configured to connect a canister or container of pressurized air having a corresponding threaded section to the air conduit of the hopper assembly, and comprises a valve actuator configured to actuate a release valve of the canister or container of pressurized air.

6. The apparatus according to claim 5, wherein the valve actuator is a butterfly actuator pin comprising an actuator pin configured to actuate the valve of the canister or container of pressurized air and a cutaway area that is configured to allow the pressurized air to enter the air conduit from the canister or container of pressurized air.

7. The apparatus according to claim 4, wherein the housing chamber is threaded and is configured to connect the air conduit to an air supply base configured to supply the pressurized air from a pressurized air source.

8. The apparatus according to claim 1, wherein the one-way valve is configured to permit a flow of pressurized air from the air conduit into the containment area and is configured to prevent a flow of pressurized air from the containment area into the air conduit, such that pressurized air in the containment area does not escape the hopper assembly through the one-way valve or air conduit.

9. The apparatus according to claim 1, wherein the one-way valve comprises a filter adjacent to the containment area configured to prevent the abrasive material from entering the one-way valve.

10. The apparatus according to claim 1, wherein the first opening of the conduit of the mixing device that is configured to intake abrasive material has a first diameter;

wherein the second opening of the conduit of the mixing device that is configured to intake pressurized air has a second diameter; and wherein the first diameter of the first opening of the conduit of the mixing device is greater than the second diameter of the second opening of the conduit of the mixing device.

11. The apparatus according to claim 10, wherein the mixing device further comprises:

a cap configured to be inserted through an opening in an outer wall of the hopper assembly; and a mounting housing configured to be inserted through the cap comprising a first end configured to be attached to the conduit of the mixing device and a second end configured to be attached to a delivery conduit to the exhaust nozzle.

12. The apparatus according to claim 1, wherein the mixing device is configured to be attached to a delivery conduit received by a stylus comprising the exhaust nozzle, wherein the stylus is configured to permit a controllable ejection of the pressurized stream of abrasive material.

13. An apparatus comprising:

a pressurized air source;

a hopper assembly comprising:

a containment area configured to store an abrasive material in a lower portion of the containment area;

an air conduit configured to receive pressurized air from a pressurized air source;

a one-way valve in fluid communication with the air conduit and configured to provide the pressurized air into an upper portion of the containment area; and a mixing device comprising a conduit, the conduit extending into the containment area and comprising a first opening into the lower portion of the containment area that is configured to intake abrasive material and a second opening into the upper portion of the containment area that is configured to intake the pressurized air, wherein the mixing device is configured to mix the abrasive material and the pressurized air to create a pressurized stream of abrasive material; and a delivery conduit comprising a flexible tube having a first end connected to the mixing device and configured to receive the pressurized stream of abrasive material and a second end received by a stylus comprising an exhaust nozzle and configured to permit a controllable ejection of the pressurized stream of abrasive material.

14. The apparatus according to claim 1, wherein the hopper assembly further comprises:

a housing chamber at an end of the air conduit that is configured to connect the air conduit of the hopper assembly to the pressurized air source.

15. The apparatus according to claim 14, wherein the housing chamber is threaded and is configured to connect a canister or container of pressurized air having a corresponding threaded section to the air conduit of the hopper assembly, and comprises a valve actuator configured to actuate a release valve of the canister or container of pressurized air.

16. The apparatus according to claim 15, wherein the valve actuator is a butterfly actuator pin comprising an actuator pin configured to actuate the valve of the canister or container of pressurized air and a cutaway area that is configured to allow the pressurized air to enter the air conduit from the canister or container of pressurized air.

17. The apparatus according to claim 14, wherein the housing chamber is threaded and is configured to connect the air conduit to an air supply base configured to supply the pressurized air from a pressurized air source.

18. The apparatus according to claim 13, wherein the one-way valve is configured to permit a flow of pressurized air from the air conduit into the containment area and is configured to prevent a flow of pressurized air from the containment area into the air conduit, such that pressurized air in the containment area does not escape the hopper assembly through the one-way valve or air conduit.

19. The apparatus according to claim 13, wherein the first opening of the conduit of the mixing device that is configured to intake abrasive material has a first diameter;

wherein the second opening of the conduit of the mixing device that is configured to intake pressurized air has a second diameter; and wherein the first diameter of the first opening of the conduit of the mixing device is greater than the second diameter of the second opening of the conduit of the mixing device.

20. The apparatus according to claim 13, wherein the stylus comprises:

a body section configured to receive the delivery conduit;

the exhaust nozzle configured to eject the pressurized stream of abrasive material; and a control lever configured to control the ejection of the pressurized stream of abrasive material through the exhaust nozzle, wherein the control lever is configured to pivot between a first position in which the control lever restricts a flow of the pressurized stream of abrasive material through the delivery conduit and a second position in which the control lever does not restrict the flow of the pressurized stream of abrasive material through the delivery conduit.

* * * * *